US005374912A

United States Patent [19]

Houck, III

[11] Patent Number: 5,374,912

[45] Date of Patent: Dec. 20, 1994

[54] CONTACTOR FLOATING MAGNET

[75] Inventor: Theodore J. Houck, III, Arden, N.C.

[73] Assignee: Eaton Corporation, Cleveland, Ohio

[21] Appl. No.: 52,844

[22] Filed: Apr. 23, 1993

Related U.S. Application Data

[63] Continuation of Ser. No. 736,362, Jul. 26, 1991, abandoned.

[51] Int. Cl.[5] ..... H01H 67/02

[52] U.S. Cl. ..... 335/132; 335/257

[58] Field of Search ..... 335/131, 132, 167–176, 335/257

[56] References Cited

U.S. PATENT DOCUMENTS

| | | | |
|---|---|---|---|
| 2,882,369 | 1/1957 | Bauer | 335/132 |
| 2,929,899 | 6/1953 | Filliette | 335/132 |
| 3,060,355 | 10/1962 | Kruzk . | |
| 3,643,187 | 2/1972 | Stallman et al. | 335/132 |
| 3,815,063 | 6/1974 | Grunert et al. | 335/160 |
| 4,377,796 | 3/1983 | Grunert et al. | 335/131 |
| 4,506,242 | 3/1985 | Karpe et al. | 335/131 |
| 4,710,740 | 12/1987 | Dennison | 335/132 |
| 4,720,763 | 1/1988 | Bauer | 361/154 |
| 4,988,964 | 1/1991 | Streich et al. | 335/131 |

FOREIGN PATENT DOCUMENTS

| | | |
|---|---|---|
| 519527 | 7/1943 | Germany . |
| 529557 | 10/1951 | Germany . |

*Primary Examiner*—Lincoln Donovan
*Attorney, Agent, or Firm*—Martin J. Moran

[57] ABSTRACT

A floating magnet mounted in an electromagnetic switch assembly. The magnet has confronting faces contacted by confronting faces of a movable armature. The movable armature is caused to contact the floating magnet by a magnetic field created when electrical current is applied to a current carrying coil. The magnet has a mounting face opposite its confronting faces. A mounting stem is anchored in the mounting face and extends through an aperture in a mounting base. The stem laterally protrudes to prevent it from pulling through the aperture in the mounting base. The magnet rests on an energy absorbing medium, such as a spring or rubber. The energy absorbing medium is disposed between the mounting face of the magnet and the mounting base. The energy absorbing medium is resilient to provide magnet flotation. Magnet flotation allows the magnet to float to align its confronting faces with those of the armature when the armature is caused to contact the magnet.

1 Claim, 7 Drawing Sheets

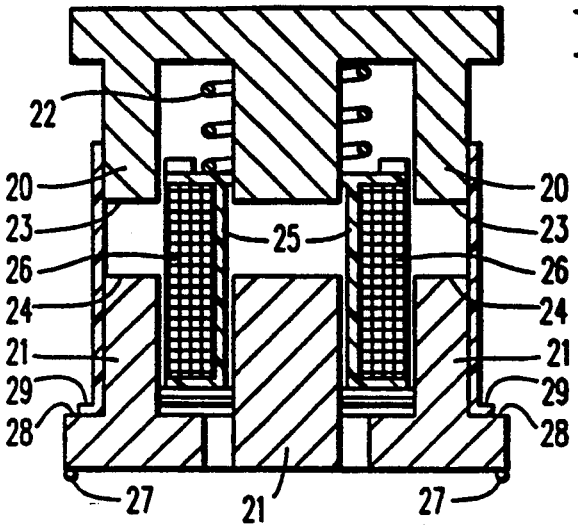
FIG. 1
PRIOR ART
FIG. 3
PRIOR ART
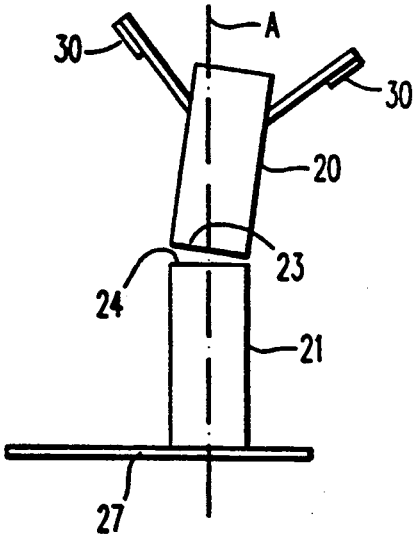
FIG. 2
PRIOR ART
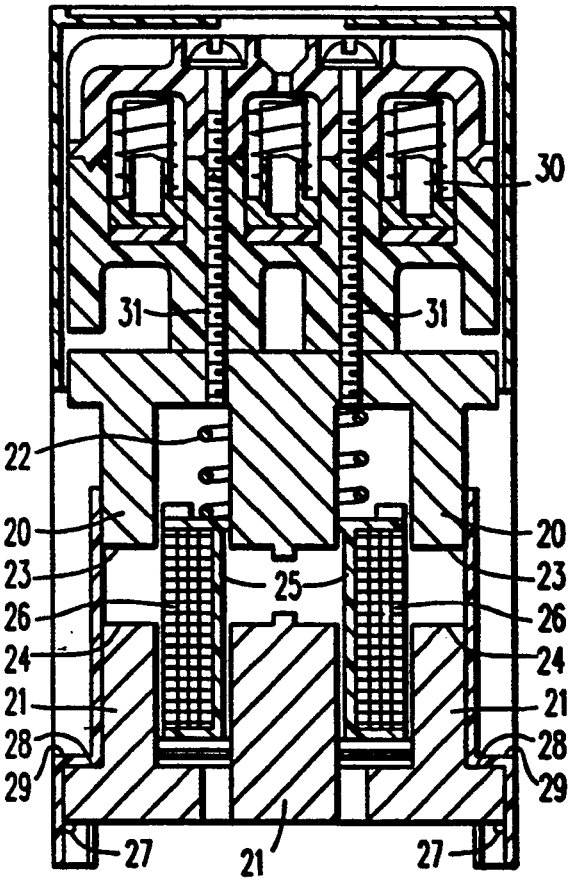

CONTACTOR FLOATING MAGNET

This application is a continuation, of application Ser. No. 07/763,362 filed Jul. 26, 1991, now abandoned.

BACKGROUND OF THE INVENTION

1. Field of the Invention

This invention relates to electromagnetic switches and more particularly to electromagnetic switches having a floating magnet with confronting faces contacted by a movable armature having confronting faces, the confronting faces flushly aligning upon contact.

2. Background Information

Electromagnetic switches, also known as contactors or motor starters, are electrically operated switches having an armature and a stationary magnet. The armature is held apart from the stationary magnet by a kick-out spring. Application of electrical energy to a coil within the switch induces the armature to overcome the bias of the kick-out spring. The armature thereby contacts the stationary magnet through magnetic attraction.

Generally, one or more electrically conductive contacts are affixed to the movable armature. Energization of the coil causes the armature to be attracted to and contact the stationary magnet. The electrically conductive contacts of the armature, in turn, touch stationary contacts affixed in the switch housing. Contact touching generally provides a circuit closure for energizing a circuit or a load.

A typical electromagnetic switch is disclosed in U.S. Pat. No. 4,720,763-Bauer. In earlier electromagnetic switches, such as Bauer, the base of the stationary magnet is supported by a wire bail. The stationary magnet, in prior art designs, resides between the bail and a solid fixed support. Although somewhat resilient, the bail provided a stiff impediment to movement by the magnet upon contacting by the movable armature. Upward vertical movement of the magnet is limited by its contact with a solid magnet support piece. This prior art design is responsible for producing secondary bounce between the electrical contacts of the switch.

A number of mechanisms can be involved to cause secondary bounce. A first mechanism is misalignment of the confronting faces of the armature and stationary magnet upon contact. This misalignment can occur in any of three dimensions. The relatively fixed position of the stationary magnet within the housing prevents the stationary magnet from moving to properly align the confronting faces of the stationary magnet with the armature. The movable armature, however, may more freely rotate in any of three dimensions. The movable armature will therefore tend to move in the dimension necessary so that the confronting faces of the armature and magnet flushly align. The electrically conductive contacts, however, are affixed to the movable armature. Movement of the armature after initially contacting the stationary magnet will move the contacts affixed to the armature relative to the stationary contacts affixed in the switch housing. Movement of the contacts after initial contact closure is secondary bounce.

Another form of secondary bounce can occur when the stationary magnet returns to its initial position after being struck by the movable armature. When the coil of the armature is energized, the armature will strike the stationary magnet. Although the bail provides stiff support to the base of the stationary magnet, it is somewhat resilient. The stationary magnet will therefore displace relative to the solid support piece when contacted by the movable armature. The displaced bail will forcefully return the stationary magnet to its original position abutting the solid support surface. The impact of the stationary magnet on the solid support surface can jar the movable armature confronting faces out of flush alignment with the confronting faces of the stationary magnet. The magnetic field between the movable armature and stationary magnet will induce the movable armature to rotate as necessary to cause the confronting faces of the armature to align with the stationary magnet. The contacts affixed to the movable armature will thereby bounce across the stationary contacts in the switch housing producing secondary bounce.

Secondary bounce is an undesirable condition which reduces the electrical life of the electrically conductive contacts due to friction, arcing, and excessive pounding. Furthermore, the unstable current flow path provided by bouncing contacts can adversely affect the waveform of the electrical signal carried by the contacts through the circuit.

There is a need therefore for an electromagnetic switch which eliminates secondary bounce by providing a floating magnet which can rotate upon contact with a movable armature thereby aligning the confronting faces of the magnet with the confronting faces of the armature without a need for movement by the armature.

SUMMARY OF THE INVENTION

These and other needs are satisfied by the invention which is directed to a floating magnet housed in an electromagnetic switch structure. The armature of the invention can be a number of various shapes and sizes. For purposes of this disclosure, the armature has a cross section of a downward facing E, thereby providing three confronting faces for contact with the floating magnet. The armature resides in a carrier which allows armature movement along an axis to or from the floating magnet. The armature is typically biased away from the floating magnet by a kick-out spring. When the coil of the armature is energized, the armature travels through the carrier towards the floating magnet. The floating magnet should have a cross section which is consistent with the cross section of the armature. In this instance the floating magnet should have the shape of an upward pointing E. The floating magnet is mounted to a fixed stiff mounting plate by a mounting stem which is anchored in a mounting face of the floating magnet. The mounting stem extends from the floating magnet through the fixed stiff plate. The mounting stem has lateral protrusions disposed on an exterior side of the fixed stiff plate to prevent the mounting stem from pulling through the plate. The mounting stem can be a screw, rivet or similar device. If a screw is used, the head of the screw will generally define the lateral projection preventing the screw from pulling through the plate. It is also preferable to dispose a pipe spacer circumferentially about the screw and disposed between the mounting face of the floating magnet and the screw head. The pipe spacers allow sufficient torquing of the screw to prevent the screw from backing out of the magnet mounting face. The pipe spacers also provide less resistance to movement through the stiff mounting plate as would the screw alone. It is preferable to anchor the mounting stem centrally in the mounting face of the floating magnet whereby it will act as a central axis allowing floating magnet rotation in any dimension. Disposed between the mounting face of the floating magnet and the stiff plate is an energy absorbing means. The energy absorbing means can be any resilient material such as a rubber or foam pad as well as a spring circumferentially disposed about the mounting stem.

The slidable mounting stem and energy absorbing means of the invention provide exceptional resilience when compared to the bail support of prior art design. The floating magnet is freely rotatable in any of the three dimensions. If the confronting faces of the armature are not flush with those of the floating magnet, the floating magnet will make the adjustments necessary to properly align the confronting faces under the force of the magnetic field between the armature and the floating magnet. This is a great improvement over prior art designs wherein the armature made the necessary aligning adjustments thereby producing secondary bounce. The greater resiliency of the energy absorbing material used in conjunction with the invention will also prevent the floating magnet from violently returning to its rest position after contact by the armature thereby preventing a further source of secondary bounce.

DESCRIPTION OF THE DRAWINGS

FIG. 1 shows a side elevation of a prior art movable armature/magnet combination.

FIG. 2 is a sectional view of a prior art electromagnetic switch.

FIG. 3 shows a front elevation of a prior art movable armature/magnet combination in a confronting state showing a bounce inducing gap between the armature and magnet.

DESCRIPTION OF THE PREFERRED EMBODIMENTS

Figure 4:
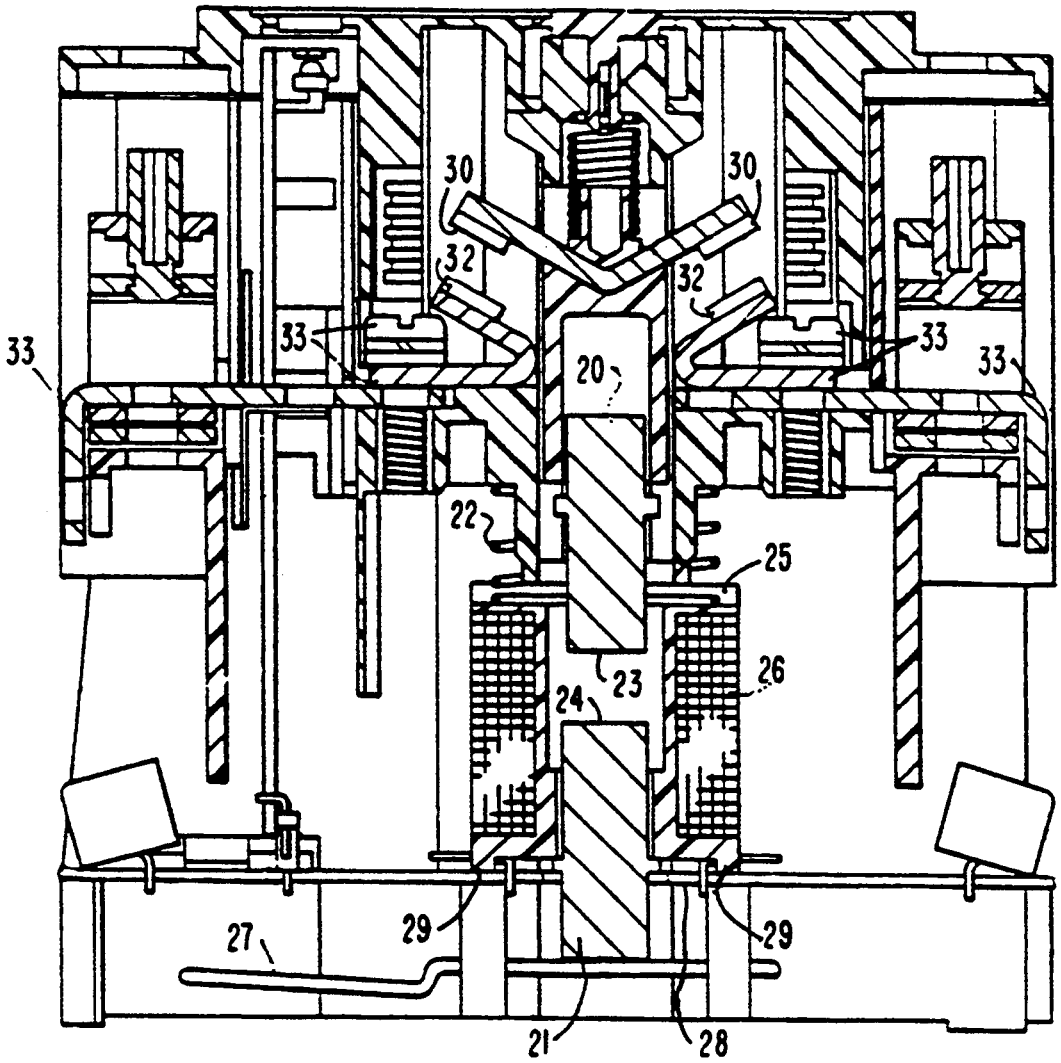
PRIOR ART FIG.4
FIG. 4 is a cut-away elevation of a prior art electromagnetic switch

The invention is a floating magnet assembly usable in an electromagnet having a movable armature with at least one confronting face, including, a magnet having at least one confronting face and an oppositely facing mounting face, a resilient mounting assembly for the magnet, the mounting assembly mounting the magnet by its mounting face and allowing the at least one confronting face of the magnet to position itself in alignment with an opposing at least one confronting face of the armature after the armature is moved into contact with the magnet. The invention is a great improvement over previous designs wherein armature motion after initially contacting the magnet caused movable electrical contacts affixed to the armature to slide across their opposing fixed contacts and bounce.

A prior art design having an E-shaped armature and magnet is illustrated in FIGS. 1 and 2. Armature 20 is biased from magnet 21 by kick-out spring 22. Armature 20 presents three confronting faces 23 to three magnet confronting faces 24. Kick-out spring 22 is supported on bobbin 25. Energizing coil 26 is wrapped about bobbin 25. Magnet 21 is supported by bail 27. Bail 27 urges magnet 21 upward whereby magnet ears 28 forcefully press against solid support 29 whereby magnet 21 is held in a relatively rigid position. Contact of magnet ears 28 with solid support 29 essentially defines side located fixation points for magnet 21. The side located fixation points provide a wide base for magnet 21 inhibiting its floating ability.

Upon energization of coil 26 armature 20 moves downward under the influence of a magnetic field generated by energized coil 26 against the bias of kick-out spring 22. Generally, upon impact of armature 20 with magnet 21 confronting faces 23 and 24 are not flushly aligned. The generated magnetic field will typically influence confronting faces 23 and 24 into flush alignment. Since magnet 21 is typically rigidly fixed, armature 20 makes the movement necessary to align confronting faces 23 and 24.

Even if confronting faces 23 and 24 initially flushly align, misalignment sometimes occurs as the electromagnet structure reaches an equilibrium position after actuation. For instance, the force of armature 20 upon magnet 21 can be sufficient to displace magnet ears 28 from their rest position against solid support 29. The upward return force exerted on magnet 21 by bail 27 violently returns magnet ears 28 to their position resting against solid support 29. The upward inertia generated on armature 20 by the upwardly moving magnet 21 is sufficient to displace armature 20 from magnet 21 when magnet ears 28 contact solid support 29. Armature 20 will continue to be drawn into contact with magnet 21 and confronting faces 23 will continue to attempt to flushly align with confronting faces 24. Armature 20 will be subject to rapid displacement in three dimensions in an attempt to flushly align confronting faces 23 with confronting faces 24. Any movement by armature 20 to align confronting faces 23 with confronting faces 24 will necessarily induce movement of movable contacts 30 (not shown in FIGS. 1 and 2). The movement of movable contacts 30 relative to fixed electrical contacts is known as secondary bounce. Secondary bounce physically damages the electrical contacts as well as distorts the waveform carried by the contacts.

FIGS. 3 and 4 illustrate other views of the prior art movable armature/magnet combination, including movable contacts 30. FIG. 3 emphasizes the non-flush alignment of confronting faces 23 and 24 which can occur when armature 20 is caused to contact magnet 21. To alleviate the gap shown between confronting face 23 and confronting face 24, armature 20 will rock to align with axis A causing secondary bounce of movable contacts 30.

As shown more clearly in FIG. 4, magnet 21 is held firmly in position by the upward force exerted by bail 27 causing magnet ears 28 to firmly press against solid support 29. Upon energization of coil 26 armature 20 will be pulled to magnet 21 thereby pulling movable electrical contacts 30 into contact with their respective fixed contacts 32. Electrical continuity will thereby become established across continuity path 33. Movement by armature 20 after initial contact with magnet 21, and hence after initial contact by movable electrical contacts 30 with fixed contacts 32 causes electrical contacts 30 to slide and bounce across fixed contacts 32. Eventually, repeated secondary bouncing of movable electrical contacts 30 on fixed contacts 32 will necessitate replacement of the movable electrical contacts 30 and fixed contacts 32. Furthermore, when switching high voltages, secondary bounce of movable electrical contacts 30 could result in arcing between movable electrical contact 30 and fixed contacts 32 or fusion of movable electrical contacts 30 to fixed contacts 32. preferred embodiment of the invention shown in FIG. 5 virtually eliminates the phenomenon of secondary bounce from electromagnetic switches. As in prior art designs, armature 20 has confronting faces 23. Magnet 21 has opposing confronting faces 24. Armature 20 is biased from magnet 21 by kick-out spring 22. Kick-out spring 22 is placed for instance, between bobbin 25 and armature 20. Coil 26 is wrapped about bobbin 25. Coil 26, when energized, pulls armature 20 against the bias of kick-out spring 22 towards magnet 21.

Figure 5:
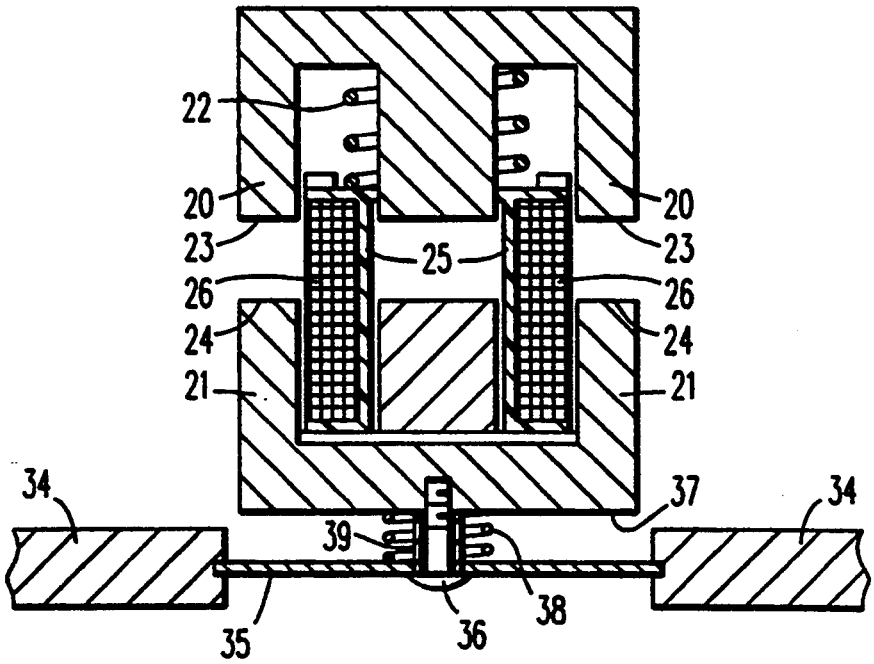
FIG. 5 is a side elevation of a movable armature/-magnet combination in accordance with the invention.

As shown in FIG. 5, magnet 21 is mounted in a novel manner to eliminate secondary bounce problems. Solid support 34 rigidly supports mounting plate 35. Mounting plate 35 has an aperture therein for passage of mounting screw 36. Mounting screw 36 is anchored in mounting surface 37 of magnet 21 opposite the confronting faces 24 of magnet 21. It is preferable to anchor a mounting screw 36 centrally on mounting surface 37 for balanced support of magnet 21. The narrow base defined by the centrally located mounting screw 36 allows excellent, three dimensional movement of magnet 21. Mounting spring 38 is disposed between mounting surface 37 and mounting plate 35. Mounting spring 38 is preferably circumferentially disposed about mounting screw 36. Mounting spring 38 should be of sufficient firmness to support magnet 21 yet resilient enough to sufficiently cushion the impact of armature 20 upon magnet 21. Since the object of the invention is to provide a magnet structure movable to provide a flush alignment of confronting faces 24 with confronting faces 23 of armature 20, mounting spring 38 must not substantially inhibit movement of magnet 21 in any of three dimensions. Spacers 39 allow mounting screw 36 to be sufficiently torqued into magnet 21 thereby preventing loosening of mounting screw 36 from magnet 21 during the lifetime of the electromagnetic switch. Furthermore, since spacers 39 must slide somewhat through the aperture in mounting plate 35 upon impact by armature 20, spacers 39 provide a decreased resistance to movement through the aperture than would screw 36 alone thereby aiding alignment of magnet 21 with armature 20.

The mounting structure as shown and described in FIG. 5 allows magnet 21 to float. When contacted by moving armature 20, magnet 21 will make the necessary adjustments to align confronting faces 24 of magnet 21 with confronting faces 23 of armature 20. Armature 20 will remain stationary while magnet 21 floats in three dimensions to flushly align confronting faces 24 with confronting faces 23.

Figure 6:
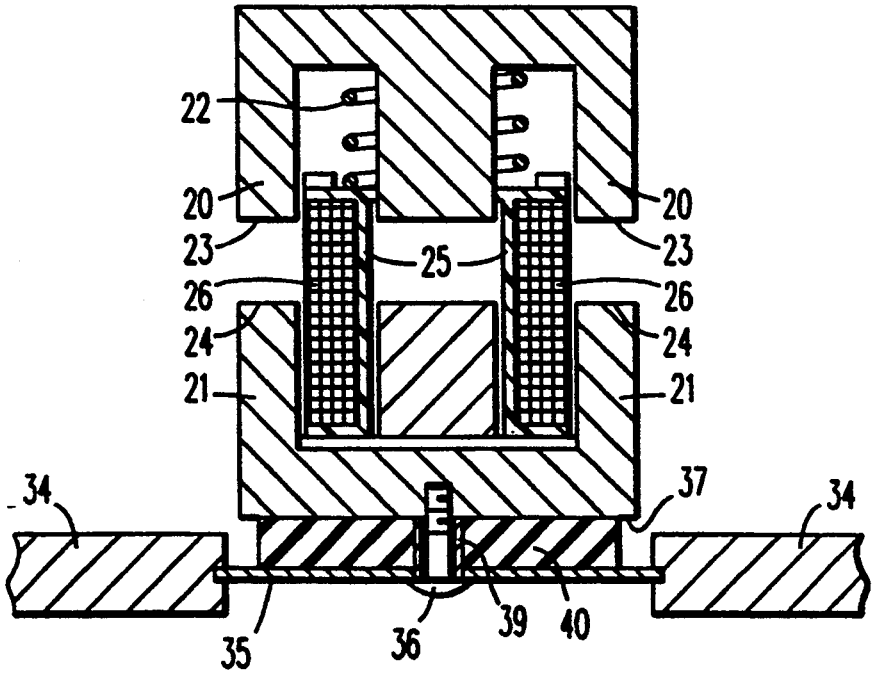
FIG. 6 is a side elevation of an alternate embodiment of a movable armature/magnet combination in accordance with the invention.

An alternate embodiment of the invention is depicted in FIG. 6. Mounting spring 38 is replaced by resilient pad 40. Resilient pad 40 is made of a synthetic resin. Resilient pad 40 is sufficiently resilient to cushion the impact of armature 20 upon magnet 21. Resilient pad 40 allows the necessary three dimensional movement of magnet 21 to align confronting faces 24 of magnet 21 with confronting faces 23 of armature 20.

Figure 7:
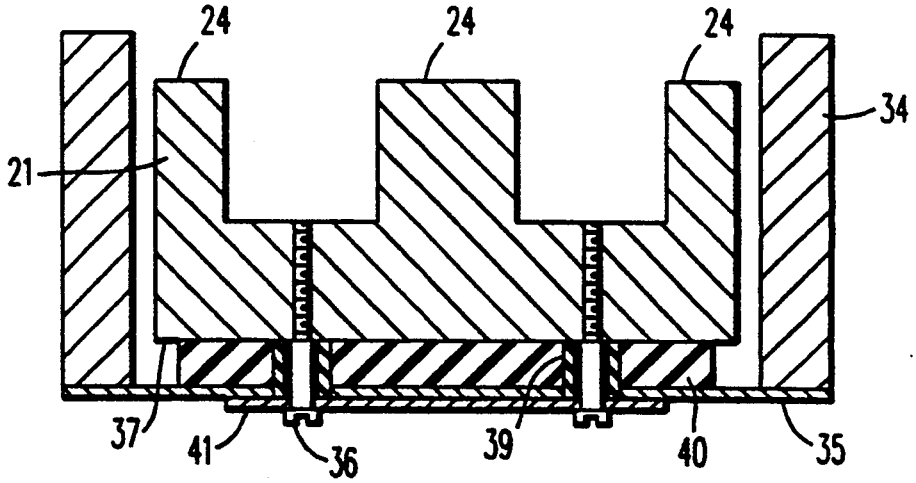
FIG. 7 is a side elevation of another alternate embodiment of a movable armature/magnet combination in accordance with the invention.

FIG. 7 shows another preferred embodiment which has two mounting screws 36 anchored into a mounting surface 37 of magnet 21. The floating magnet structure is mounted on mounting plate 35. As in other embodiments, an energy absorbing medium is disposed between mounting plate 35 and mounting surface 37 of magnet 21. As shown, resilient pad 40 is used as the energy absorbing medium. Although providing somewhat less floatation than embodiments having a single mounting stem anchored into mounting surface 37 of magnet 21, the embodiment of FIG. 7 provides the necessary floatation of magnet 21 whereby confronting faces 24 align with the opposing confronting faces 23 (not shown in FIG. 7) of armature 20. Of course, the further mounting screws 36 are disposed from center vertical axis A, the wider a base is provided for magnet 21. If screws 36 are disposed a maximum distance from center vertical axis A, such as near the outer-most ends of magnet 21, flotation could be reduced enough to negate the secondary bounce eliminating quality of the invention.

Float plate 41 provides a base for securing mounting screws 36 and prevents the heads of screws 36 from pulling through mounting plate 35. Float plate 41 freely resides between the head of mounting screws 36 and mounting plate 35. In this manner, float plate 41 will space from mounting plate 35 when mounting screws 36 are propelled away from mounting plate 35, such as when magnet 21 is impacted by armature 20. It is possible to use individual washers in place of float plate 41 to prevent the heads of screws 36 from pulling through mounting plate 35, however, uneven tilting of magnet 21 during operation could subject one of the washers to increased wear as compared to the other thereby imbalancing the mounting structure. Although it is preferable to use float plate 41 for preventing mounting stem pull-through, care must be taken to avoid using a float plate 41 which extends to far out from center axis A. An overly extended float plate could inhibit movement of magnet 21 in at least one dimension thereby depreciating the secondary bounce reducing characteristic of the invention.

Figure 8:
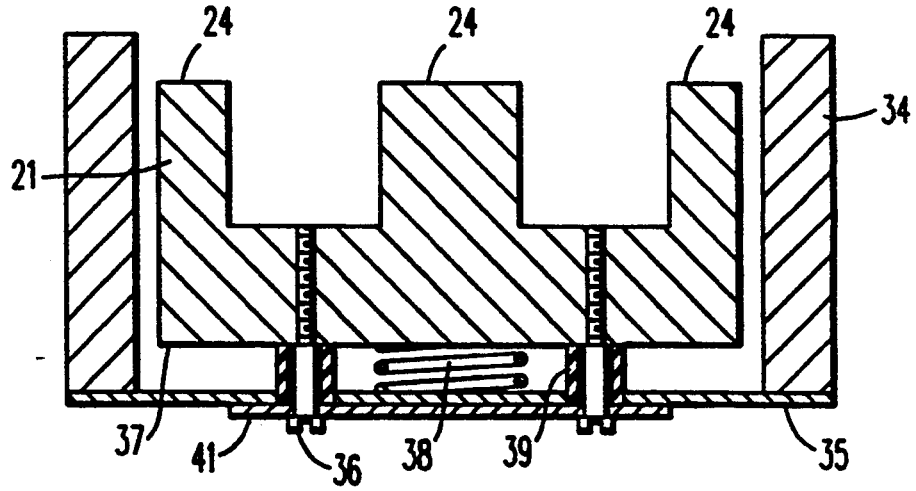
FIG. 8 is a side elevation of yet another alternate embodiment of a movable armature/magnet combination in accordance with the invention.

FIG. 8 is a similar magnet support structure as that shown in FIG. 7, however, mounting spring 38 is substituted for resilient pad 40.

Figure 9:
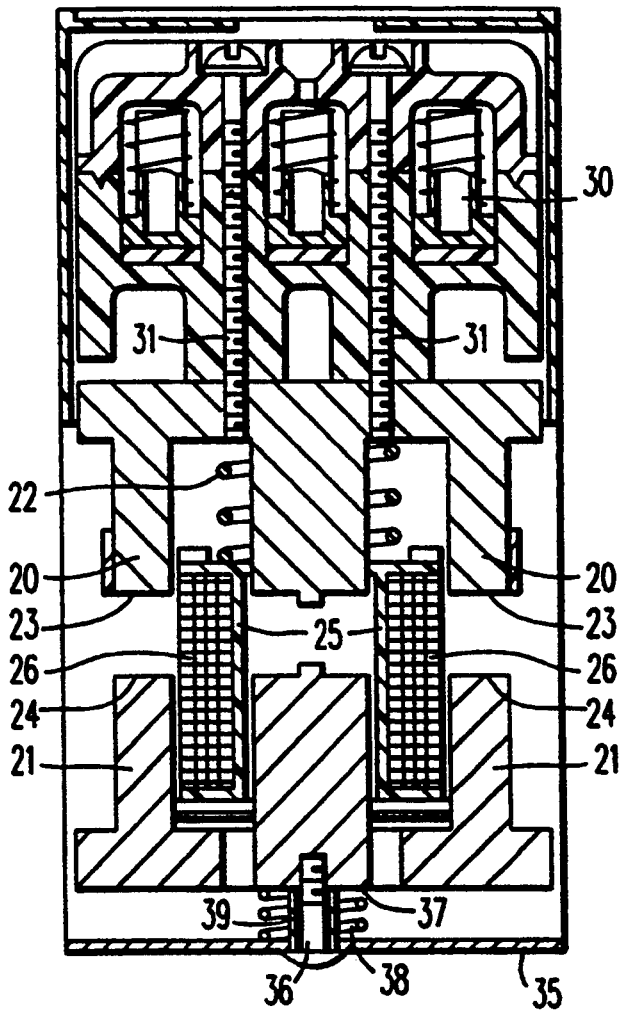
FIG. 9 is a sectional view of an electromagnetic switch in accordance with the invention.
Figure 10:
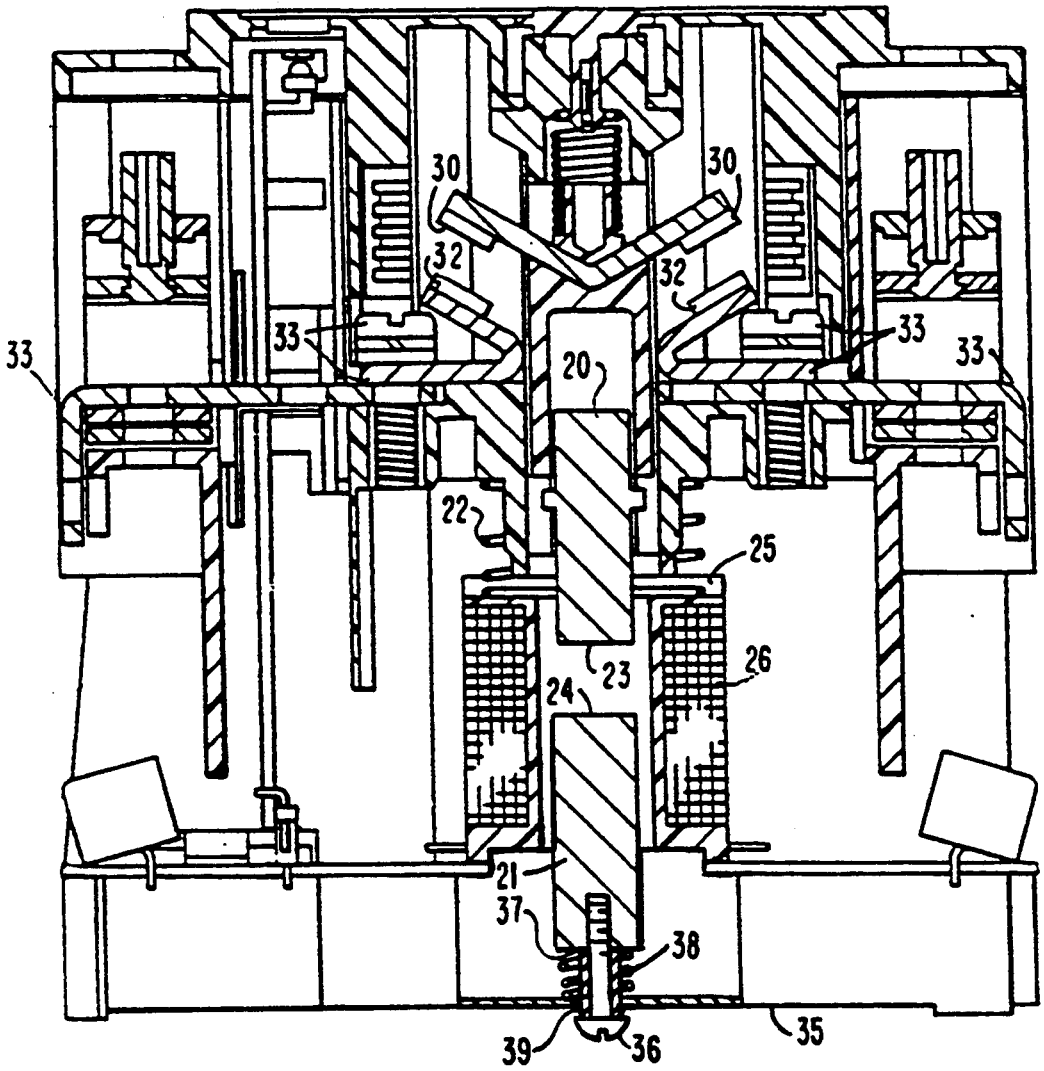
FIG. 10 is a cut away view of an electromagnetic switch in accordance with the invention.

FIGS. 9 and 10 show the invention as used in a typical electromagnetic switch. In each of FIGS. 9 and 10, energy absorbing means for providing floatation of magnet 21 is supplied by inclusion of mounting spring 38. In FIGS. 9 and lid magnet 21 will float upon impact by armature 20 to align confronting faces 24 of magnet 21 with confronting faces 23 of armature 20. Since magnet 21 will move under the influence of a magnetic field to align with armature 20, armature 20 will remain essentially motionless. In this manner movable contacts 30 are not subject to secondary bounce after initially contacting fixed contacts 32.

Figure 11:
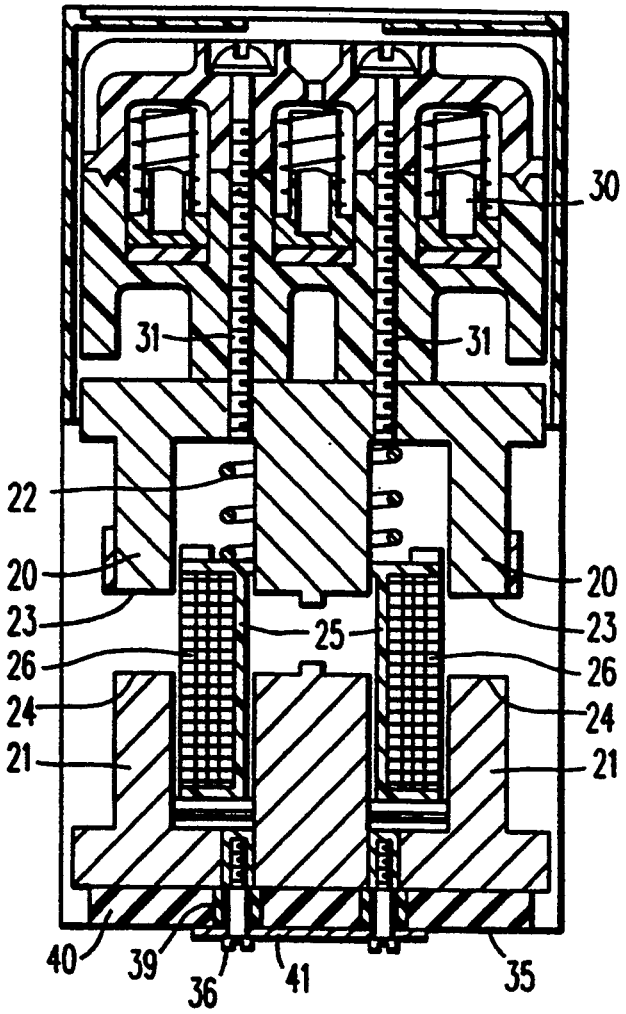
FIG. 11 is a sectional view of another embodiment of an electromagnetic switch in accordance with the invention.

FIG. 11 shows another embodiment of the invention as used in a typical electromagnetic switch. In FIG. 11, magnet 21 is anchored by plural screws 36. FIG. 11 also includes float plate 41 which provides a seat for the heads of screws 36 thereby preventing screws 36 from pulling through mounting plate 35.

It can be appreciated from the above that the invention provides excellent contactor performance by virtually eliminating the phenomenon known as secondary bounce. Secondary bounce causes contact deterioration and distorted waveforms. The invention is unique in that the magnet is affixed within the switch at a magnet base opposite the magnet confronting faces as opposed to having affixation points at its side.

While specific embodiments of the invention have been described in detail, it will be appreciated by those skilled in the art that various modifications and alternatives to those details could be developed in light of the overall teachings of the disclosure. For instance, mounting screw 36 has been disclosed for movably securing magnet 21 to mounting plate 35. However, other mounting stems can be used in accordance with the disclosure such as, rivets, pins and other essentially elongated smooth projections having a stop means equivalent to the screw head for preventing the mounting stem means from pulling upwardly through mounting plate 35. Furthermore, energy absorbing means other than resilient pad 40 or springs 38 are usable in conjunction with the invention. Accordingly, the particular arrangements disclosed are meant to be illustrative only and not limiting as to the scope of the invention which is to be given the full breadth of the appended claims and any and all equivalents thereof.

I claim:

1. A floating magnet assembly usable in an electromagnetic switch having a movable armature with at least one confronting face, comprising:

a magnet having at least one opposing confronting face and an oppositely facing mounting face;

a resilient mounting assembly for said magnet, said mounting assembly mounting said magnet by said oppositely facing mounting face resiliently with at least opposing confronting face of said magnet free to flushly align in full contact with said at least one confronting face of the armature when the armature is moved into contact with said magnet, said resilient mounting assembly includes two screws anchored in said mounting face of said magnet, said screws having heads, a fixed mounting plate having a magnet side and an exterior side, said screws anchored to said mounting face extending through an at least one aperture in said fixed mounting plate, said screw heads disposed on the exterior side of said mounting plate, a resilient pad disposed between said mounting face of said magnet and said fixed mounting plate providing flotation of said magnet permitting flush alignment of said at least one magnet opposing confronting face with said at least one armature confronting face; and a float plate having at least one aperture for passage of said screws therethrough, said at least one aperture in said float plate being narrower than said screw heads, said float plate disposed between said screw heads and said exterior side of said fixed mounting plate thereby preventing said screw heads from pulling through said mounting plate.

* * * * *